United States Patent [19]

Frederick

[11] 4,366,870

[45] Jan. 4, 1983

[54] PILE HAMMER CUSHION BLOCK

[76] Inventor: Leonard L. Frederick, 15 Crestview Ter., Whippany, N.J. 07981

[21] Appl. No.: 89,780

[22] Filed: Oct. 31, 1979

[51] Int. Cl.[3] ..... B25D 17/12; F16F 15/04

[52] U.S. Cl. ..... 173/131; 173/139

[58] Field of Search ..... 173/139, DIG. 2, 126, 173/128, 131, 132; 428/465, 215, 216, 214; 267/137; 405/232; 145/61 R, 61 B, 61 F, 61 M; 181/288, 284, 230; 260/37 M, 42.22; 242/68.5

[56] References Cited

U.S. PATENT DOCUMENTS

| | | | |
|---|---|---|---|
| 839,189 | 12/1906 | Oberbeck | 242/68.5 |
| 839,439 | 12/1906 | Underdown | 242/68.5 |
| 1,178,143 | 4/1916 | Evans | 173/131 |
| 1,473,450 | 11/1923 | Thornton | 242/68.5 |
| 1,585,600 | 5/1926 | Proctor | 242/68.5 |
| 1,657,387 | 1/1928 | Goldschmidt | 173/131 X |
| 1,943,420 | 1/1934 | Budd | 173/131 |
| 2,226,589 | 12/1940 | Smyers | 428/465 X |
| 2,931,186 | 4/1960 | Frederick | 173/131 X |
| 2,993,806 | 7/1961 | Fisher et al. | 428/216 |
| 3,051,598 | 8/1962 | Chipman et al. | 428/214 X |
| 3,427,264 | 2/1969 | Forster et al. | 260/42.22 X |
| 3,455,864 | 7/1969 | Dodson et al. | 260/42.22 X |
| 3,900,644 | 8/1975 | Sackoff et al. | 428/215 X |

FOREIGN PATENT DOCUMENTS

| | | | |
|---|---|---|---|
| 2361979 | 8/1976 | France | 173/131 |
| 1183422 | 3/1970 | United Kingdom | 173/131 |

*Primary Examiner*—Werner H. Schroeder
*Assistant Examiner*—Andrew M. Falik
*Attorney, Agent, or Firm*—Edwin E. Greigg

[57] ABSTRACT

A block of cushioning material arranged to be disposed in a cavity within a drive cap of a pile hammer, the drive cap being positioned on the upper end of a pile for impact engagement by the ram with the block of cushioning material during a pile driving operation, the block of cushioning material being of high heat conductivity and arranged in heat transfer relationship with the inner wall of the cavity whereby hysteresis heat generated within the block of cushioning material during impact driving is conducted by the block to the drive cap acting as a heat sink for ultimate radiation of the heat into the ambient air.

13 Claims, 11 Drawing Figures

Fig 1.
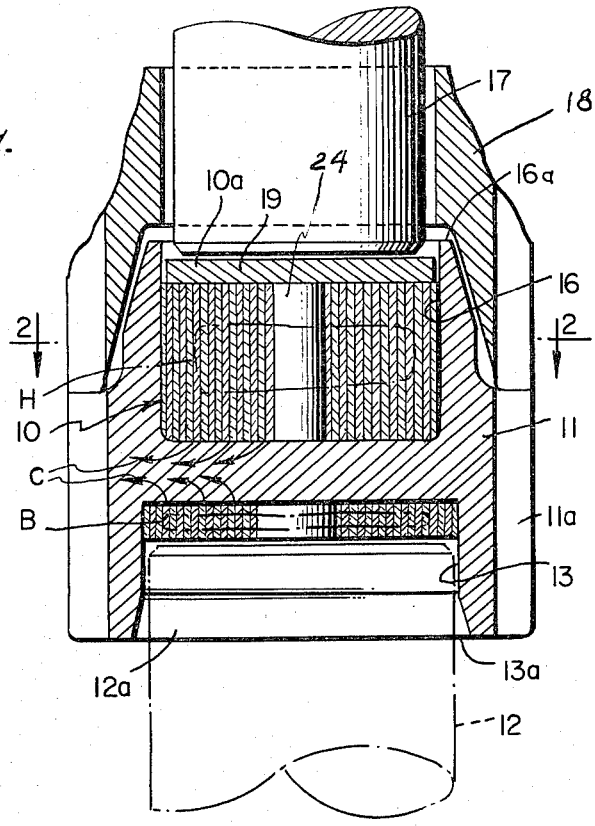
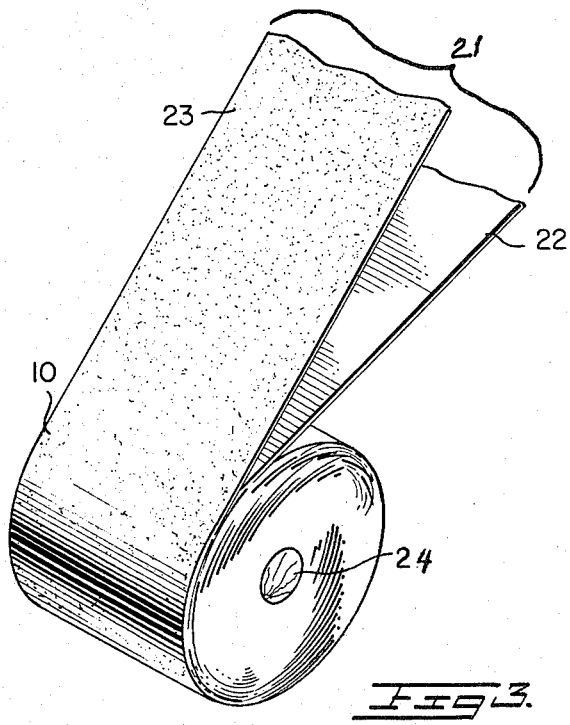
Fig 3.
Fig 2
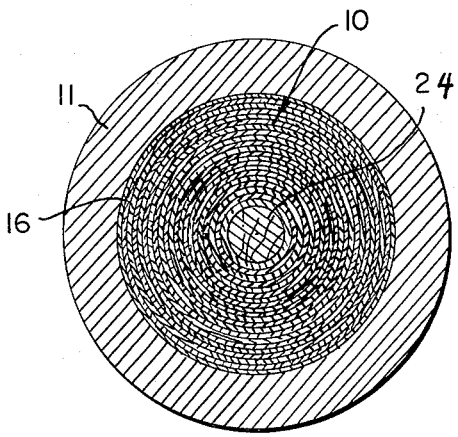

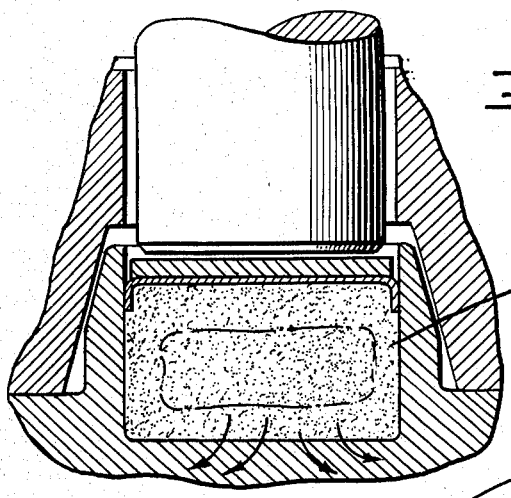
Fig 8.
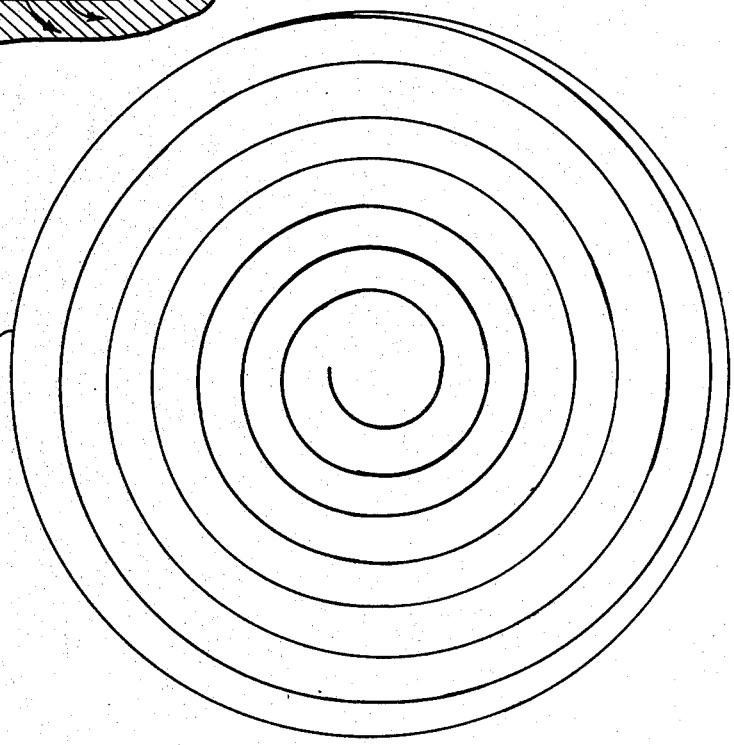
Fig 9.
Fig 10.
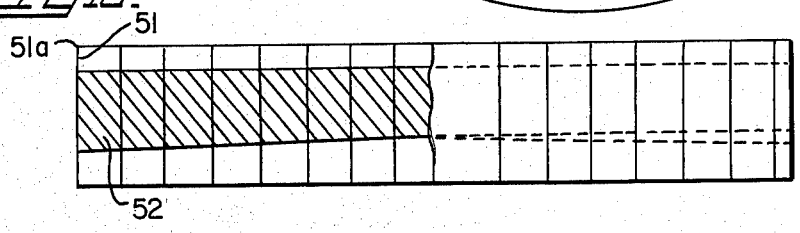
Fig 11.
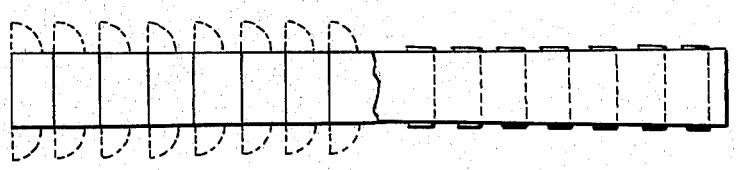

PILE HAMMER CUSHION BLOCK

BACKGROUND OF THE INVENTION

In the use of a pile hammer for driving a pile into strata, such as the ground, the common practice is to utilize a cushion block, commonly referred to as an impact block or dolly, which is disposed within a drive cap referred to also as an anvil or follower, which is positioned on the upper end of the pile for receiving the impact force of the pile hammer ram during the pile driving operation. This cushion block serves three closely related purposes. First, it reduces metal fatigue by preventing the ram point from striking the drive cap directly. Secondly, it attenuates the driving force of the ram by absorbing a portion of the energy passing through it to the drive cap and pile. Thirdly, it attenuates the rebound force from the pile to the hammer. This rebound force approximates the hammer impact force when the pile approaches refusal driving. In some cases, the reflected shock wave from the strata agrees in frequency with the rebound of the pile to cause a total rebound of approximately twice the input force. These events vary over a period of time from about 0.003 seconds to 0.017 seconds, depending on the type of hammer, the pile material and the soil strata.

As the driving force builds up and the time duration shortens, there is an increase in the rate of energy per second passing through the cushion block. This causes greater deformation and therefore the generation of more internal heat referred to generally as hysteresis heat. Such hysteresis heat is generally defined as the heat generated by the friction between the molecules of a material or gas rubbing on one another when they are compressed or impacted. Such hysteresis heat is developed when compressing air or hammering on metal.

Cushion blocks in use today employ such material as hard wood, micarta, solid nylon discs and the like. These materials all have heat insulating qualities which prevent the heat from being readily dissipated to the metal drive cap for ultimate removal into the ambient air. Therefore, the temperature of the cushion block rises during the pile driving operation and destruction results to the block either by plastic flow or ignition.

OBJECTS AND SUMMARY OF THE INVENTION

Accordingly, a primary object of this invention is to provide a new and novel cushion block for a pile hammer which rapidly dissipates heat developed during the pile driving operation into the ambient air.

Another object of this invention is to provide a new and novel pile hammer cushion block which utilizes readily available inexpensive materials such as paper and aluminum foil, paper with foil backing, wood cellular products with foil, impregnated paper and foil, vulcanized fiber and foil, plastic and foil, cloth and foil, aluminum chips and synthetic resinous material and a metal together with an elastomeric material which have a useful life far exceeding cushion blocks in use today.

Still another object of this invention is to provide a new and novel pile hammer cushion block which may be used with a drive cap of conventional construction, which permits the pile driving operation to be carried out quickly and efficiently and which virtually eliminates any damage to the pile during the driving operation.

A still further object of this invention is to provide a new and novel cushion block for a pile hammer which may be formed in a variety of forms, utilizing inexpensive materials, all of which permit rapid dissipation of the heat developed during a pile driving operation and which enables the maximum force to be utilized during the impact of the ram with the pile during the pile driving operation.

A still further object of this invention is to provide a new and novel method for positioning a cushion block for a pile hammer in the block retaining portion of the pile hammer apparatus which permits the cushion to be easily reduced in diameter insuring a necessary snug fit prolonging the useful life of the block.

The objects stated above and related objects are accomplished in the invention by the provision of a drive cap having a metal body arranged to be positioned on the upper end of a pile to be driven, the drive cap having an upper portion provided with a cavity in the open end of which the ram is accommodated during impact driving of the pile. Disposed within this cavity is a block of cushioning material of high heat conductivity in heat transfer relationship with the drive cap together with a stike plate disposed in the cavity in overlying relationship with the surface of the cushioning material so that the hysteresis heat generated within the block of cushioning material during impact engagement by the ram of the hammer is conducted by the block of cushioning material to the drive cap acting as a heat sink for ultimate radiation of the heat into the ambient air.

The invention will be better understood as well as further objects and advantages thereof become more apparent from the ensuing detailed description of a number of preferred embodiments taken in conjunction with the drawings.

BRIEF DESCRIPTION OF THE DRAWINGS

FIG. 1 is a vertical sectional view of a portion of a pile hammer in an operative position which incorporates one embodiment of the cushion block of the invention;

FIG. 2 is a sectional view taken substantially along line 2—2 of FIG. 1 in the direction of the arrows;

FIG. 3 is a perspective view of a cushion block utilized in the embodiment of FIG. 1;

FIG. 8 is a sectional view similar to FIG. 1 showing another embodiment of the cushion block of the invention FIG. 9 is a plan view of still another embodiment of the cushion block of the invention;

FIG. 10 is a sectional view showing the cushion block of FIG. 9 in an initial stage of manufacture; and FIG. 11 is a view similar to FIG. 10 showing the cushion block of FIG. 9 in the final stage of manufacture.

DESCRIPTION OF THE PREFERRED EMBODIMENTS

Figure 4:
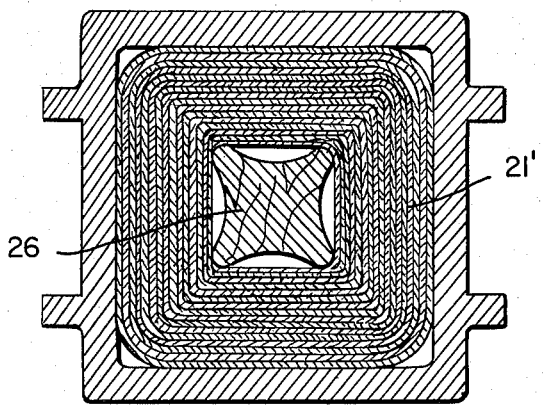
FIG. 4 is a transverse sectional view of a modification of the cushion block of FIG. 1.

Referring now to the drawings and to FIG. 1 in particular, there is shown one embodiment of the cushion block of the invention designated generally by the numeral 10 in an operative position within an assembly of parts incorporated in a pile hammer of conventional construction. As is well known, such a pile hammer includes a drive cap 11 in the form of a massive steel body which is arranged to be positioned on the upper end of a pile 12 to be driven into strata such as the ground. The drive cap 111 may be provided with fins 11*a* for dissipating heat developed therein into the ambient air.

The drive cap 11 is provided with a lower cavity 13 having an open end 13*a* for accommodating the upper end or head 12*a* of the pile 12 to be driven. The upper portion of the drive cap 11 is provided with a cavity 16 having an open upper end 16*a* for accommodating the point of a ram 17 guidably disposed within a hammer base 18.

As specifically illustrative of the invention, the cushion block 10 is disposed within the upper cavity 16 and has an upper surface 10*a* on which a strike plate 19, circular in cross-section, is positioned for engagement by the ram point 17 during the pile driving operation. The cushion block 10 is preferably of circular cross-section, having a diameter for nesting snugly within the cavity 16 in heat transfer relationship with the inner wall of the cavity 16 and includes a material of high heat conductivity. The heat generated during the pile driving operation is localized within the block 10 in a zone referred to as a hysteresis heat zone H.

In the embodiment of FIG. 1, the cushion block 10 comprises a convolutely wound cylindrical body as shown best in FIG. 3 wound from sheet material 21 comprising a multi-ply laminate of metal 22 and paper 23. In the preferred embodiment, the metal ply 22 is of aluminum foil and is laminated together in any well known manner with the paper ply 23 to form the strip 21 of sheet material. Also, the convolutely wound body 10 is preferably provided with a core 24, preferably of wood, on which the strip 21 is wound and the body 10 is disposed within the cavity 16 with its longitudinal axis extending in the direction of the axis of the ram 17 as shown in FIG. 1. In accordance with the invention, a metal ply 22 may be provided on both sides of the paper ply 23. Other possible combinations of materials for the strip 21 may be a cloth and foil laminate, a laminate of impregnated paper and foil or a laminate of a cellulosic cellular material and foil.

It should be understood that portions of the metal component of the cushion block 10 is necessarily in intimate contact with the inner wall of the cavity 16. In order to have heat transfer to the inner walls 16, the multi-ply laminate of metal 22 must be on the outside of the paper ply 23 in contact with the inner wall. Therefore, to accomplish this, the aluminum foil ply 22 extends vertically within the cavity 16 with its lower edges in heat transfer engagement with the bottom wall of the cavity. Since the aluminum foil extends vertically in the cavity and is in contact with the bottom of the cavity heat is conducted to the cap 11.

In the embodiment of FIG. 4, the strip 21' is formed similarly to the strip 21 of FIGS. 1–3, and includes a core 26 also preferably of wood, but of cruciform shape as shown around which the strip 21' is wound. It should be understood that the cushion block 10 should be snuggly fitted within the cavity 16 thereby resisting deformation of the block during use.

During the pile driving operation, the heat developed in the cushion block 10 confined generally to the hysteresis heat zone H is quickly conducted by the aluminum foil 22 to the inner wall of the cavity 16 in the direction of the arrows C into the metal body of the drive cap 11 so that the drive cap 11 acts as a heat sink substantially reducing the temperature of the cushion block 10. Since the drive cap 11 is exposed to ambient air, the heat conducted into the body of the drive cap is radiated quickly into the ambient air so that the temperature of the block 10 is maintained at a relatively low level preventing the deleterious effects of heat on the block 10 which would otherwise occur.

As the diameter of the cavity 16 in various drive caps used in pile hammer apparatus varies, to provide a block 10 in accordance with the embodiment of FIGS. 1–4 having a specific diameter would not necessarily provide the required snug fit between the block 10 and cavity 16. It is therefore within the scope of the invention to provide a wound block 10 in a diameter somewhat larger than the inner diameter of such cavities 16. The leading portion of the multi-ply laminate 22, 23 can then be peeled away and severed until the resulting diameter of the block 10 is such as to snugly fit within the cavity 16.

Figure 5:
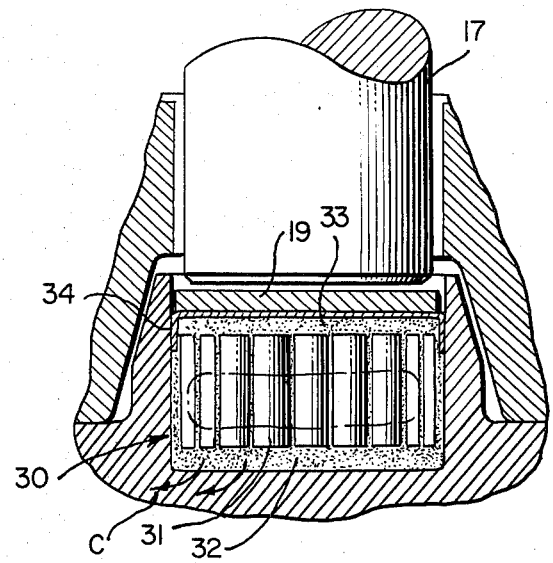
FIG. 5 is a view similar to FIG. 1 showing a second embodiment of the cushion block of the invention.
Figure 6:
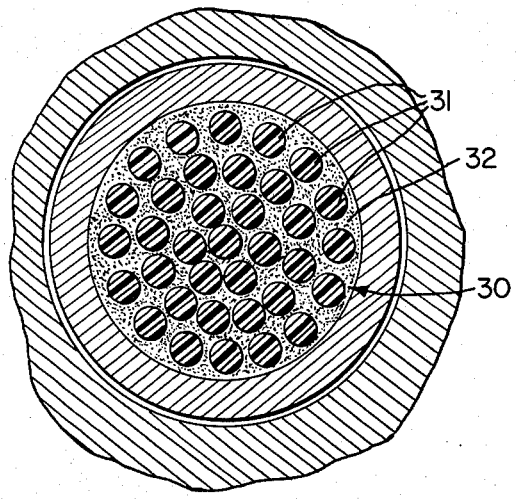
FIG. 6 is a sectional view taken substantially along line 6—6 of FIG. 5.
Figure 7:
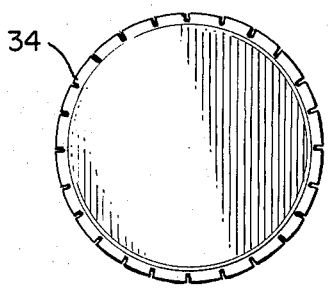
FIG. 7 is a perspective view of a component part of the cushion block arrangement of FIG. 5.

Referring now to FIG. 5, there is shown another embodiment of the invention wherein like numerals are used to identify like parts. In the embodiment of FIG. 5, the cushion block designated generally by the numeral 30 is disposed within the upper cavity 16 of the drive cap 11 and includes a plurality of rod members 31 pf synthetic resinous material such as a plastic, arranged in parallel relationship within a matrix 32 comprising metal particles such as aluminum chips. The rod members 31 are stacked together as shown with their longitudinal axes extending in the direction of the axis of the ram 7 and a particle retaining cover member 33 having an annular flange 34 is disposed over the upper surface of the matrix 32 in underlying relationship with the strike plate 19. The annular flange 34 of the cover member 33 is preferably provided with circumferentially spaced serrations 34*a* which aid in retaining the metal particles of the matrix 32 within the cavity 16. The circular shape of the cover member 33 is such as to position the flange 34 in snug-fitting engagement with the inner wall of the cavity 16. As in the embodiment of FIG. 1, the heat developed in the hysteresis heat zone H within the block 30 is conducted quickly through the aluminum particles forming the matrix 32 to the inner wall of the drive cavity 16 into the body of the drive cap 11 which acts as a heat sink for ultimate dissipation of heat into the ambient air.

In the embodiment of FIG. 8, wherein like numerals are used to identify like parts, the cushion block 40 is formed of a mixture of particles of synthetic resinous material such as plastic pellets and particles of metal of a high heat conductivity such as aluminum chips. As in the embodiment of FIG. 5, the mixture of particles formed in the block 40 are confined in the cavity 16 by means of the cover member 33 and as a result of the high heat conductivity of the aluminum chips, hysteresis heat is conducted in the direction of the arrows C into the body of the drive cap 11 for ultimate dissipation into the ambient air.

In the embodiment of FIGS. 9–11, the block 50 is of multi-ply construction including a ply 51 of a metal having a high heat conductivity such as aluminum and a ply 52 of an elastomeric material such as a plastic or the like wound convolutely or cast in convolute form with the ply 51, 52 in alternating relationship as shown in FIGS. 9–11. The metal ply 51 has a width greater than that of the elastomeric ply 52 so, in the initial stage of manufacture, the metal ply 51 has side edge portions 51*a*, 51*b*, extending outwardly on opposite sides of the elastomeric strip 52 as shown in FIG. 10. Subsequently, the edge portions 51*a*, 51*b* are folded over into overlying relationship with the side edges of the elastomeric strip 52 to form the configuration shown in FIG. 11. Thus, the edge folded metal ply 51 forms a good conducting surface for engagement with the inner wall of the cavity 16 and also serves to hold any elastomeric fragments in place when work hardening cracks develop.

As in the previous embodiments, hysteresis heat is conducted from the block 50 by the metal ply 51 into the drive cap 11 for ultimate dissipation into the ambient air.

Preferably, a cushion block B is positioned within the lower cavity 13 of the drive plate 11 and the block B may be constructed similar to any of the embodiments discussed above relative to the cushion block in the upper cavity 16 of the drive cap 11. Similarly, hysteresis heat developed within the cushion block B is conducted into the body of the drive cap 11 in the direction of the arrows C for ultimate dissipation into the ambient air.

What is claimed and desired to be secured by Letters Patent of the United States is:

1. A cushion block for the drive cap of a pile hammer having a ram for impact driving a pile into strata comprising, in combination, a drive cap having a metal body arranged to be positioned on the upper end of a pile, said drive cap metal body having an upper portion provided with an upper cavity having an open upper end for accommodating said ram during impact driving of said pile, a convolutely wound body of cushioning material comprising a multiple laminate including a ply of heat conductivity material and a supporting layer of non-metallic material so that the longitudinal axis of said convolutely wound body is coaxial with the longitudinal axis of said cavity and contained and nesting snugly within said cavity in heat transfer relationship with said drive cap and a strike plate disposed in said cavity overlying relationship with the surface of said block of cushioning material for impact engagement by said ram whereby hysteresis heat generated within said block of cushioning material during said impact driving is conducted by said block of cushioning material to said drive cap acting as a heat sink for ultimate radiation of the heat into the ambient air.

2. A cushion block as claimed in claim 1 wherein
said heat conductivity material is metal foil; and
said non-metallic material is a ply of paper material.

3. A cushion block in accordance with claim 2 wherein said metal foil is aluminum.

4. A cushion block in accordance with claim 3 wherein said convolutely wound body includes a central core member of wood on which said multi-ply laminate is convolutely wound.

5. A cushion block in accordance with claim 1 wherein said block of cushioning material includes a convolutely wound body having a plurality of plies, said plurality of plies including a strip of metal having a high heat conductivity and a strip of synthetic resinous material with said strips arranged in alternating relationship, said metal strip having a width greater than that of the width of said strip of synthetic resinous material and having side edge portions folded over into overlying relationship with the side edges of said strip of synthetic resinous material.

6. A cushion block in accordance with claim 5 wherein said metal strip is aluminum.

7. A cushion block in accordance with claim 1 wherein said drive cap has a lower portion provided with a lower cavity with an open lower end for accommodating the upper end of said pile and a block of cushioning material of high heat conductivity contained within said lower cavity whereby the hysteresis heat generated within said cushioning material in said lower cavity during said impact driving is conducted to said drive cap acting as a heat sink for ultimate radiation of the heat into the ambient air.

8. A method of sizing a cushion block in a pile hammer apparatus comprising the steps of:

snugly fitting a cushion block of a convolutely wound body of a sheet material within a cavity of a drive cap, wherein said convolutely wound body of sheet material comprises a multi-ply laminate including a ply of metal foil and a ply of paper material, said convolutely wound body having a diameter slightly greater than the diameter of said drive cap cavity, determining the diameter of said drive cap cavity, peeling away a leading portion of said sheet material to the extent to provide a diameter on said body sufficient for producing said snug fitting relationship between said cavity and said cushion block body disposed therein, severing said leading portion from said body, and inserting said cushion block in said cavity so that the longitudinal axis of said convolutely wound body is coaxial with the longitudinal axis of said cavity.

9. A cushion block for a drive cap of a pile hammer having a ram for impact driving a pile into strata comprising at least one sheet of heat conductive metalic material and a sheet of non-heat conductive non-metallic material convolutely wound in a cylindrical body about a longitudinal axis, said convolutely wound cylindrical body positioned coaxially in a drive cap metal body having at least one longitudinally extending cavity having an open upper end for accommodating a ram during impact driving of a pile with said sheet of heat conductive metallic material in heat transfer relationship with said drive cap metal body and a strike plate disposed in said open upper end between said cushion clock and said ram whereby hysteresis heat generated within said cushion block during impact driving will be conducted by said block of cushioning material to said drive cap acting as a heat sink for ultimate radiation of generated heat into surrounding ambient air.

10. A cushion block as claimed in claim 9, in which said sheet of non-heat conducting non-metallic material is sandwiched between two layers of metallic material.

11. A cushion block as claimed in claim 10, wherein said metallic layer is aluminum.

12. A cushion block as claimed in claim 9, wherein said metallic layer is aluminum foil.

13. A method of using a convolutely wound composite cylindrical body including an elongated strip of heat conductive material adhered to an elongated strip of non-heat conductive material comprising placing said convolutely wound structure in a cap cavity of a pile driver with said heat conductivity material in heat conductive relationship with said cap and with its longitudinal axis coaxial with said cap cavity.

* * * * *